US006811519B2

(12) United States Patent
Kuo

(10) Patent No.: US 6,811,519 B2
(45) Date of Patent: Nov. 2, 2004

(54) DUAL TREADMILL HAVING ADJUSTABLE RESISTANCE

(76) Inventor: Hai Pin Kuo, No. 15, Lane 833, Wen Hsien Road, Tainan (TW)

( * ) Notice: Subject to any disclaimer, the term of this patent is extended or adjusted under 35 U.S.C. 154(b) by 0 days.

(21) Appl. No.: 10/401,625

(22) Filed: Mar. 27, 2003

(65) Prior Publication Data

US 2004/0192512 A1 Sep. 30, 2004

(51) Int. Cl.[7] ..... A63B 22/02
(52) U.S. Cl. ..... 482/54; 482/112
(58) Field of Search ..... 482/51–54, 71, 482/72, 74, 111, 112

(56) References Cited

U.S. PATENT DOCUMENTS 4,204,673 A * 5/1980 Speer, Sr. ..... 482/5
5,336,146 A * 8/1994 Piaget et al. ..... 482/54
5,626,539 A * 5/1997 Piaget et al. ..... 482/54
5,669,856 A * 9/1997 Liu ..... 482/51
6,162,151 A * 12/2000 Tani et al. ..... 482/54
6,461,279 B1 10/2002 Kuo ..... 482/54
2001/0016542 A1 8/2001 Yoshimura

* cited by examiner

*Primary Examiner*—Nicholas D. Lucchesi
*Assistant Examiner*—Tam Nguyen
(74) *Attorney, Agent, or Firm*—Charles E. Baxley

(57) ABSTRACT

A dual treadmill device includes two tread bases each having one end pivotally secured to the seat, and two actuators coupled between the other ends of the tread bases and the seat, and two adjusting devices attached to the actuators, in order to adjust the actuators to different resistive forces respectively and separately. Each of the actuators includes a rotary member, each of the actuating devices includes a driving device, and a coupling device coupled between the driving device and the rotary member of the actuators, in order to rotate the rotary member by the driving device via the coupling device.

9 Claims, 5 Drawing Sheets

DUAL TREADMILL HAVING ADJUSTABLE RESISTANCE

BACKGROUND OF THE INVENTION

1. Field of the Invention

The present invention relates to a treadmill device, and more particularly to a dual treadmill device having dual treads that may be adjusted to different resistive forces separately.

2. Description of the Prior Art

Various kinds of typical treadmill devices have been developed and used today, and comprise a single tread base attached to a seat or the like, for supporting the users, and for allowing the users to conduct walking or jogging exercises. However, the typical dual treadmill devices may not be used to conduct stepping exercises simultaneously.

The present applicant has then developed a typical dual treadmill device which is issued as U.S. Pat. No. 6,461,279 to Kuo, and which includes two treads for supporting the users, and for allowing the users to conduct walking or jogging exercises, and for allowing the users to conduct stepping exercises simultaneously.

US 2001/0016542A1 to Yoshimura discloses another typical dual treadmill device which also includes two treads for supporting the users, and for allowing the users to conduct walking or jogging exercises, and for allowing the users to conduct stepping exercises simultaneously.

However, the resistive actuators or cylinders attached to the dual treads of the typical dual treadmill device should be moved or actuated together with the treads respectively, and thus may not be suitably adjusted to different resistive forces, and thus may not provide different resistive forces against to the users.

The present invention has arisen to mitigate and/or obviate the afore-described disadvantages of the conventional dual treadmill devices.

SUMMARY OF THE INVENTION

The primary objective of the present invention is to provide a dual treadmill device including two treads that may be adjusted to different resistive forces respectively or separately.

The other objective of the present invention is to provide a dual treadmill device including two treads that may be adjusted to different resistive forces without stopping the treadmill device, or without stopping the walking or jogging exercises.

In accordance with one aspect of the invention, there is provided a dual treadmill device comprising a seat, two tread bases each including a first end pivotally secured to the seat, and each including a second end, two actuators coupled between the second ends of the tread bases and the seat respectively, and two adjusting devices attached to the actuators, to adjust the actuators to different resistive forces respectively and separately.

Each of the actuators includes a rotary member provided thereon, each of the actuating devices includes a driving device, and a coupling device coupled between the driving device and the rotary member of the actuators, in order to rotate the rotary member by the driving device via the coupling device.

The rotary member may be a gear attached to each of the actuators. The driving device may be a motor. The coupling device may be a gearing coupling device coupled between the gear and the motor. The motor includes a pinion attached thereto, and engaged with the aid gear.

A housing may further be provided and attached to each of the actuators, to receive the coupling device and to support the driving device respectively. The housing includes a plate secured to a respective actuator, a board secured to the plate with spacers and fasteners.

Further objectives and advantages of the present invention will become apparent from a careful reading of the detailed description provided herein below, with appropriate reference to the accompanying drawings.

DETAILED DESCRIPTION OF THE PREFERRED EMBODIMENT

Figure 1:
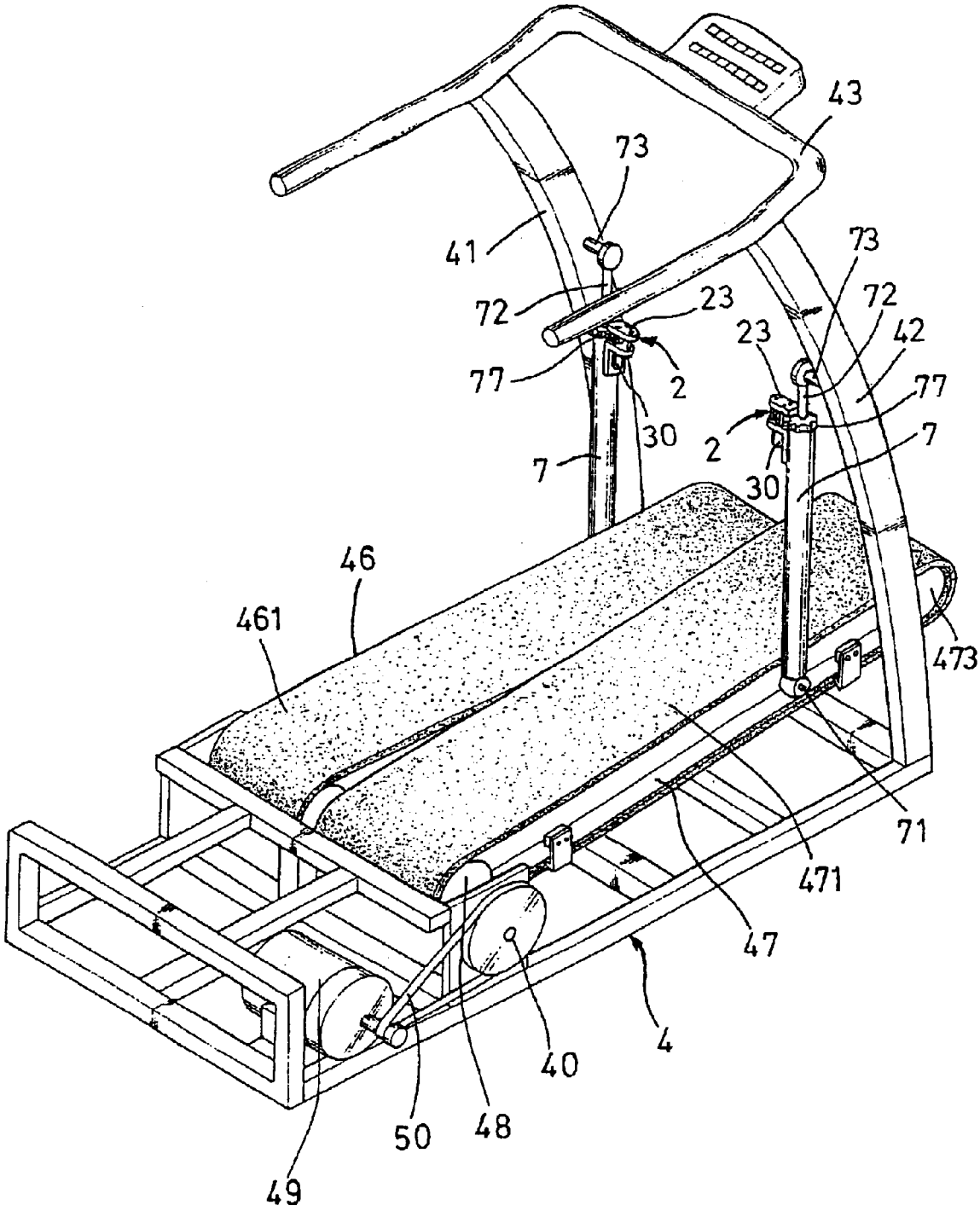
FIG. 1 is a perspective view of a dual treadmill device in accordance with the present invention.
Figure 2:
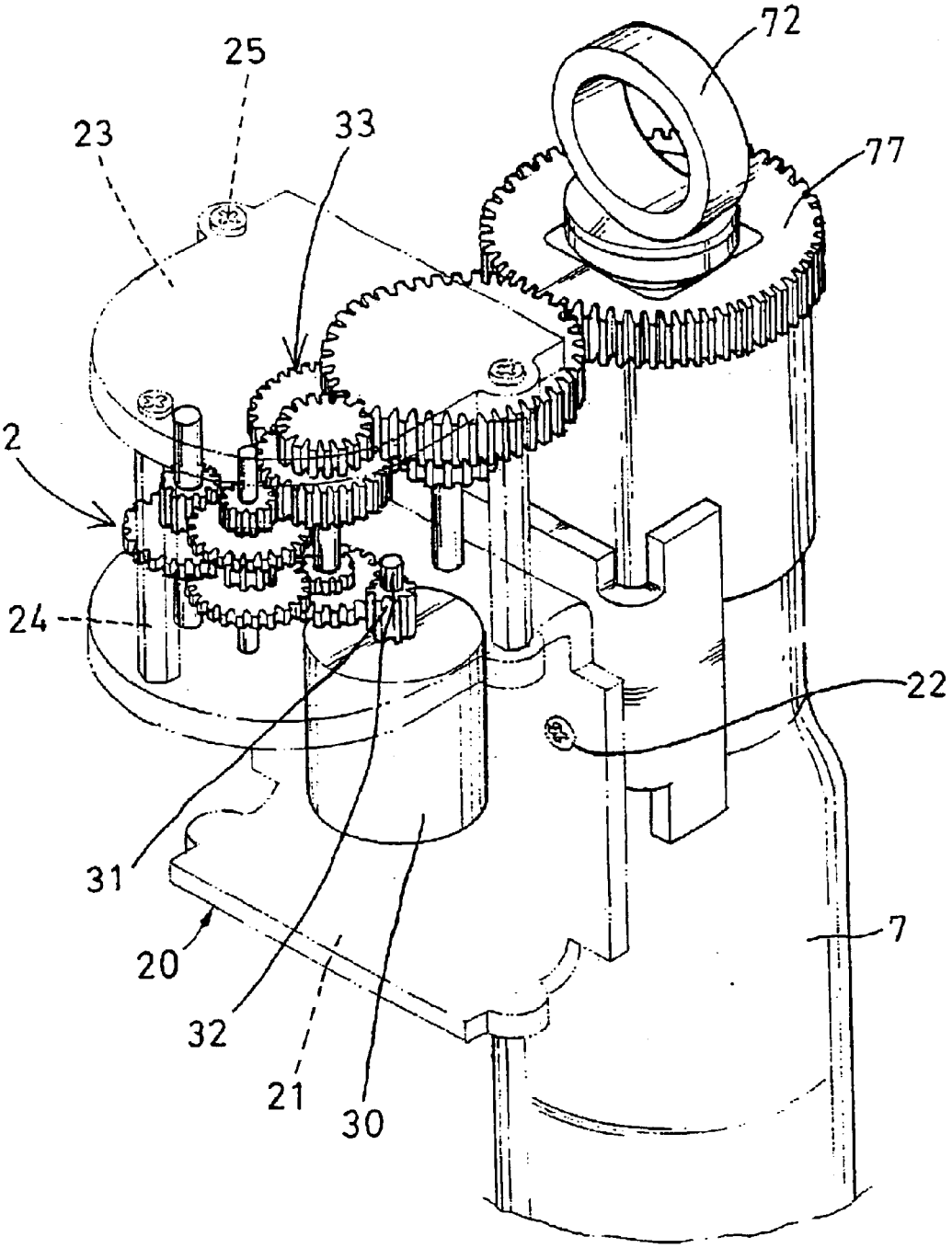
FIG. 2 is a partial perspective view of the dual treadmill device.
Figure 3:
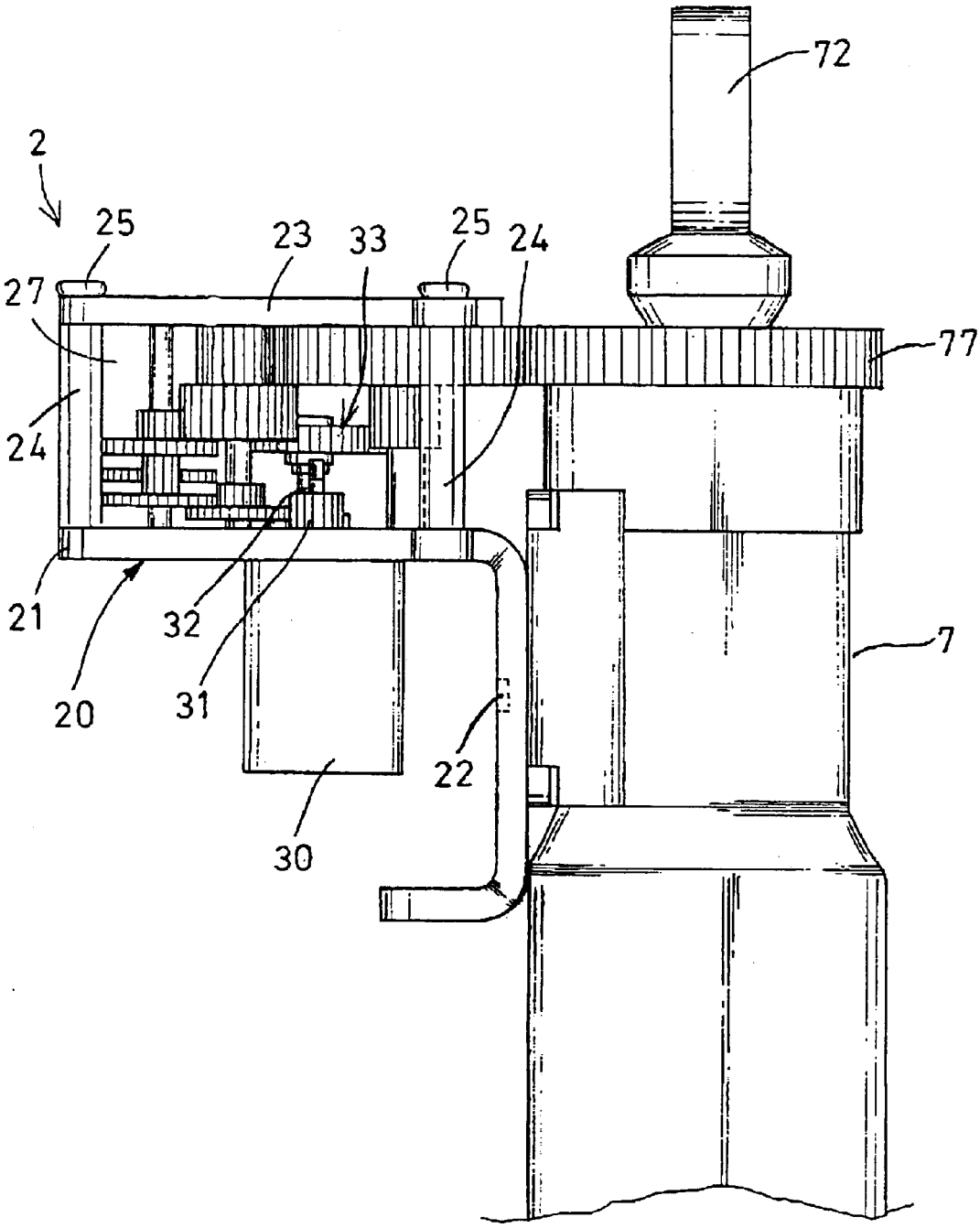
FIG. 3 is a front plan view of the dual treadmill device as shown in FIG. 2.
Figure 4:
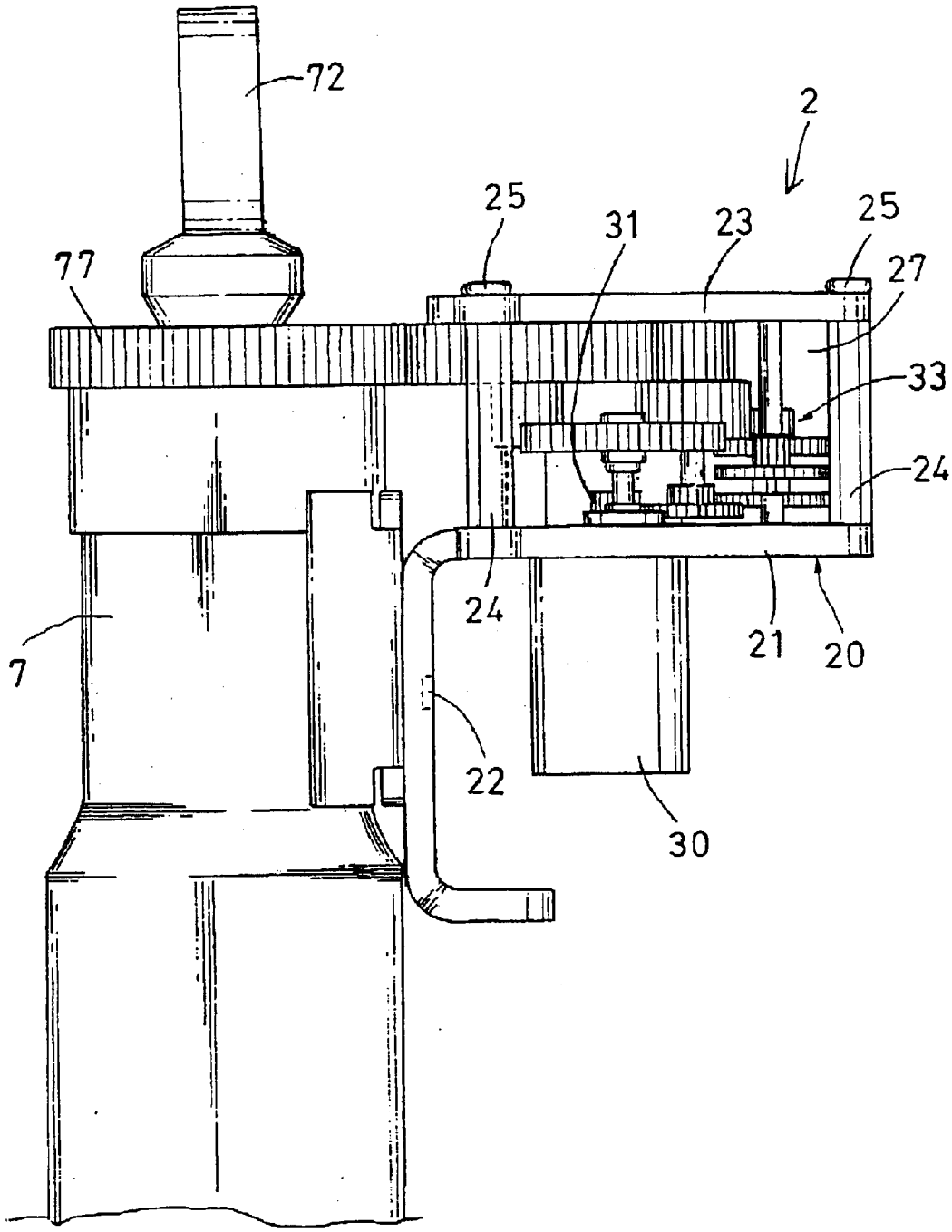
FIG. 4 is a rear plan view of the dual treadmill device as shown in FIGS. 2 and 3.

Referring to the drawings, and initially to FIGS. 1–4, a dual treadmill device in accordance with the present invention comprises a seat 4 having one or more posts 41, 42 extended upwardly from the front portion thereof, and one or more hand grips 43 provided or attached on top of the posts 41, 42 for supporting the upper portions of the users.

The dual treadmill device includes two tread bases 46, 47 each having one end, such as the rear end pivotally or rotatably secured to the seat 4 with a pivot shaft 40, for allowing the tread bases 46, 47 to be rotated or moved up and down relative to the seat 4, and thus for allowing the users to conduct walking or jogging exercises, and for allowing the users to conduct stepping exercises simultaneously.

The tread bases 46, 47 each may include a typical endless belt 461, 471 engaged around a respective tread frame 463, 473 (FIGS. 1, 5) with rollers 48, and a driving device 49 coupled to the rollers 48 or the pivot shaft 40 with a pulley-and-belt coupling device 50, or a gearing and coupling device (not shown), or a sprocket-and-chain coupling device (not shown), for allowing the driving device 49 to rotate or actuate the endless belts 461, 471 to rotate around the respective tread frame 463, 473.

The configuration of the tread bases 46, 47 are typical and will not be described in further details. In addition, two examples of the configurations of the tread bases 46, 47 have been disclosed in U.S. Pat. No. 6,461,279 to Kuo, and US 2001/0016542A1 to Yoshimura, which are thus to be taken as references for the present invention.

Two resistive cylinders or actuators 7 are attached or coupled between the two tread bases 46, 47 of the dual treadmill device and the seat 4, for providing resistive forces to the two tread bases 46, 47 separately. The actuators 7 each may include one end rotatably or pivotally secured to the respective tread bases 46, 47 with pivot axles 71, and each may include a slidable or extendible rod 72 pivotally secured to the respective posts 41, 42 of the seat 4 with pivot pins 73.

Figure 5:
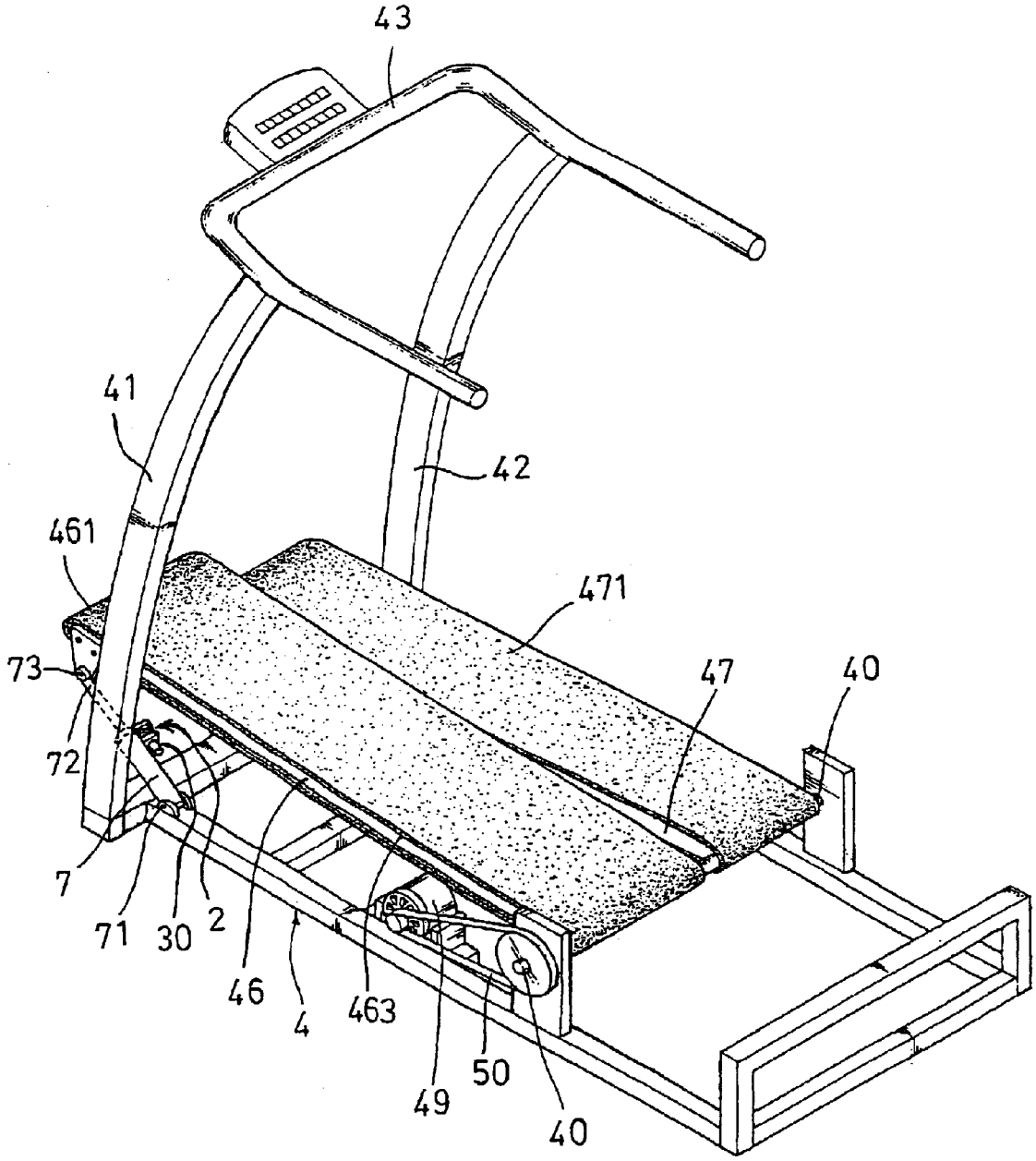
FIG. 5 is a perspective view illustrating the other arrangement of the dual treadmill device.

Alternatively, as shown in FIG. 5, The actuators 7 each may include one end rotatably or pivotally secured to the seat 4 with the pivot axles 71, and each may include a slidable or extendible rod 72 pivotally secured to the respective tread bases 46, 47 with the pivot pins 73. In both arrangements as shown in FIGS. 1 and 5, the actuators 7 may be rotatably or pivotally secured between the seat 4 and the tread bases 46, 47 respectively, in order to provide resistive force against the tread bases 46, 47 respectively and separately.

The above described configurations of the tread bases 46, 47 and the driving devices 49 and the coupling devices 50, and the actuators 7 are also typical and will not be described in further details, and have also been disclosed in U.S. Pat. No. 6,461,279 to Kuo, and US 2001/0016542A1 to Yoshimura, which are thus to be taken as references for the present invention.

The present invention is to provide two adjusting means or devices 2 to be attached to the actuators 7 respectively, in order to adjust the resistive force against the tread bases 46, 47 respectively and separately. The adjusting devices 2 each includes a housing 20 having a plate 21 secured to the respective actuators 7 with fasteners 22, for example. The actuators 7 each may include a rotary member 77, such as a gear 77 rotatably provided and attached to one end thereof.

The housing 20 includes a board 23, and one or more spacers 24 are disposed between the plate 21 of the housing 20 and the board 23, and the board 23 is secured to the plate 21 of the housing 20 with one or more fasteners 25, in order to form a chamber 27 between the plate 21 and the board 23.

A driving device, such as a motor 30 is attached or secured to the housing 20 with such as fasteners (not shown), and includes a pinion 31 attached to the spindle 32 thereof, and to be rotated or driven by the driving device motor 30. A coupling device 33, such as a pulley- and-belt coupling device, or a sprocket-and-chain coupling device, or a gearing coupling device 33 is rotatably received in the chamber 27 of the housing 20, and coupled between the pinion 31 and the gear 77, for allowing the motor 30 to rotate or drive the gear 77 via the pinion 31 and the gearing coupling device 33, and thus to adjust the resistive forces of the actuators 7 respectively.

It is to be noted that the actuators 7 are rotatably or pivotally secured between the seat 4 and the tread bases 46, 47 respectively, in order to provide resistive force against the tread bases 46, 47 respectively and separately. The attachment of the two adjusting devices 2 to the actuators 7 allows the actuators 7 to be adjusted to different resistive forces respectively and separately.

The dual treadmill device may provide one or more control devices or buttons (not shown) on top of the posts 41, 42 or on the hand grips 43, for allowing the users to adjust the actuators 7 to different resistive forces respectively and separately without stopping the walking or jogging exercises.

Accordingly, the dual treadmill device in accordance with the present invention includes two treads that may be adjusted to different resistive forces respectively or separately, and that may be adjusted to different resistive forces without stopping the operation of the treadmill device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A dual treadmill device comprising:

a seat, two tread bases each including a first end pivotally secured to said seat, and each including a second end, two actuators coupled between said second ends of said tread bases and said seat respectively, and each of said actuators including a rotary member provided thereon, two adjusting devices attached to said actuators, to adjust said actuators to different resistive forces respectively, and separately each of said adjusting devices including a driving device, and a coupling device coupled between said driving device and said rotary member of said actuators, in order to rotate said rotary member by said driving device via said coupling device, and a housing attached to each of said actuators, to receive said coupling device and to support said driving device respectively.

2. The dual treadmill device as claimed in claim 1, wherein said rotary member is a gear attached to each of said actuators.

3. The dual treadmill device as claimed in claim 2, wherein said driving device is a motor.

4. A dual treadmill device comprising:

a seat, two tread bases each including a first end pivotally secured to said seat, and each including a second end, two actuators coupled between said second ends of said tread bases and said seat respectively, each of said actuators including a rotary member provided thereon and being a gear attached to each of said actuators, and two adjusting devices attached to said actuators, to adjust said actuators to different resistive forces respectively and separately, each of said adjusting devices including a driving device, and a coupling device coupled between said driving device and said rotary member of said actuators, in order to rotate said rotary member by said driving device via said coupling device, said driving device being a motor, and said coupling device being a gearing coupling device coupled between said gear and said motor.

5. The dual treadmill device as claimed in claim 4, wherein said motor includes a pinion attached thereto, and engaged with said gear.

6. The dual treadmill device as claimed in claim 1, wherein said driving device is a motor.

7. The dual treadmill device as claimed in claim 6, wherein said rotary member is a gear attached to each of said actuators.

8. The dual treadmill device as claimed in claim 7, wherein said motor includes a pinion attached thereto, and engaged with said gear.

9. The dual treadmill device as claimed in claim 1, wherein said housing includes a plate secured to a respective actuator, a board secured to said plate with spacers and fastners.

* * * * *